US007380542B1

(12) United States Patent
Herrington

(10) Patent No.: US 7,380,542 B1
(45) Date of Patent: Jun. 3, 2008

(54) FUEL VENT TANK FOR MARINE CRAFT

(76) Inventor: Allen Gene Herrington, 3405 Marion Pl., Greenbanks, WA (US) 98253

( * ) Notice: Subject to any disclaimer, the term of this patent is extended or adjusted under 35 U.S.C. 154(b) by 0 days.

(21) Appl. No.: 11/592,052

(22) Filed: Nov. 1, 2006

Related U.S. Application Data

(60) Provisional application No. 60/732,755, filed on Nov. 1, 2005.

(51) Int. Cl.
*F02M 37/02* (2006.01)
*F02M 37/04* (2006.01)

(52) U.S. Cl. ..... 123/509; 141/307

(58) Field of Classification Search ..... 123/509, 123/516, 518; 141/311 R, 86, 343, 307; 220/86.2; 137/571
See application file for complete search history.

(56) References Cited

U.S. PATENT DOCUMENTS 3,709,202 A * 1/1973 Brown ..... 123/73 R
3,857,350 A 12/1974 Rohan
4,829,968 A * 5/1989 Onufer ..... 123/518
4,854,469 A 8/1989 Hargest
4,963,169 A * 10/1990 Granville ..... 96/178
5,054,453 A * 10/1991 Onufer ..... 123/516
5,229,766 A 7/1993 Hargest
5,230,372 A * 7/1993 Westphal ..... 141/86
5,469,800 A 11/1995 Brotz
5,501,255 A 3/1996 Tortu et al.
5,506,564 A 4/1996 Hargest
5,515,891 A * 5/1996 Langlois ..... 141/307
5,727,603 A * 3/1998 Langlois ..... 141/1
5,950,688 A * 9/1999 Langlois ..... 141/1
6,152,196 A * 11/2000 Kehoe ..... 141/198
6,929,039 B2 8/2005 Vaitses

* cited by examiner

*Primary Examiner*—Mahmoud Gimie
(74) *Attorney, Agent, or Firm*—Todd N. Hathaway

(57) ABSTRACT

An apparatus for preventing discharge of fuel from vent line when fueling a boat or other marine craft. A collection tank is mounted in the vent line from the main fuel tank, upstream of the overboard vent of the vessel. The collection tank includes a small, secondary reservoir within the main volume of the tank. Fuel escaping the main tank through the vent line enters the collection tank through two fitting, one being located in the bottom of the collection tank within the secondary reservoir and the other being located outside the reservoir; air displaced from the tank escapes to the overboard vent through an outlet fitting in the top of the collection tank. A float switch or other liquid level sensor is located within the secondary reservoir and is operatively connected to a warning light or other alarm device. Because the secondary reservoir is smaller than the main volume of the collection tank the fuel fills the reservoir first, and thus actuates the warning device well in advance of the main volume of the collection tank filling up with fuel that might escape through the overboard vent.

17 Claims, 6 Drawing Sheets

FUEL VENT TANK FOR MARINE CRAFT

RELATED APPLICATIONS

This application claims the benefit of U.S. Provisional Patent Application No. 60/732,755 filed on 1 Nov. 2005.

BACKGROUND a. Field of the Invention

The present invention relates generally to apparatus for preventing marine fuel spills, and, more particularly, to an apparatus for preventing the spilling of fuel from a vent line when filling the fuel tank of a boat or other marine craft.

b. Related Art

Fuel systems for boats and other marine craft must be provided with a vent, both to allow the fuel tank to be filled and to permit fuel to flow from the tank to the engine during operation. During refueling, the vent allows air to escape from the tank as it is displaced by the fuel (i.e., gasoline or diesel) entering through the main filler tube. As the tank reaches its capacity, the fuel tends to rush up the vent line and "spit" out the vent opening at the exterior of the hull, which is in fact commonly relied on as an indication that the tank is full.

Unfortunately, any fuel ejected from the vent opening will be discharged into the water, in violation of various governmental regulations. Boat owners have therefore resorted to a variety of stratagems for capturing the fuel ejected from the vent opening, none being entirely satisfactory. For example, many fueling docks provide their customers with a small paper cup in which to catch the gasoline or diesel as it spits from the vent opening; not only is the cup cumbersome and annoying to use, but the imperfect nature of this technique almost invariably results in some of the fuel being spilled into the water.

A number of attempts have been made at providing an installed system for preventing fuel from being discharged from the vent opening, several of which having employed an overflow or collection tank that is mounted in the vent line. This approach has the potential for obviating the difficulties of trying to catch the fuel as it is discharged from the vent opening, but again none have been entirely successful.

For example, U.S. Pat. No. 6,929,039 shows a simple overflow tank that is mounted in parallel with the vent line to capture excess fuel, with restrictive orifices that control the rate at which fuel is able to enter the tank. However, there is still the risk that fuel will be discharged from the vent opening, if the overflow tank becomes full or the rate of flow is excessive so that it bypasses the tank.

U.S. Pat. No. 4,854,469 shows a collection tank that utilizes an arrangement of openings and baffles to prevent the fuel from flowing directly to the vent opening, but that otherwise exhibits the same problems as the device described in the preceding paragraph. The tank shown in U.S. Pat. No. 4,854,469 has the advantage of a window that enables the operator to see the level of fuel that has been collected and therefore stop filling before fuel overflows through the vent opening; however, mounting the collection tank so it can be seen from the exterior of the boat when refueling (for example, by cutting a hole in the deck or cockpit wall), is simply impractical for most craft.

U.S. Pat. No. 5,229,766 shows a more sophisticated device, that uses a two-stage, tapered guide tube for the fuel, a sliding float within the tube, reed switches that are actuated by a bar magnet mounted on top of the float, a switch circuit that activates an audible alarm in response to actuation of the reed switches, a plunger-operated reset mechanism, and so on. Although the use of an audible alarm avoids the problem of having to view the tank directly, the complexity of this device and its use of numerous dedicated components render it uneconomical to produce, particularly in the marine products market where high retail markups are the norm.

Accordingly, there exists a need for an apparatus for preventing the discharge of gasoline, diesel, or other liquid fuel from the vent opening of a boat or other marine craft while filling the main tank thereof. Furthermore, there exists a need for such an apparatus that is effective when the main tank is being filled at fast rates as well as slow rates. Still further, there exists a need for such an apparatus that provides the operator with an effective warning before the capture tank is filled. Still further, there exists a need for such an apparatus that can be conveniently mounted on boats and other marine craft having conventional construction. Still further, there exists a need for such an apparatus that is durable and reliable in operation. Still further, there exists a need for such an apparatus that is economical to produce and that can be competitively priced in the marine products market.

SUMMARY OF THE INVENTION

The present invention has solved the problems cited above, and is an apparatus for preventing discharge of fuel from a vent line when fueling a boat or other marine craft. Broadly, the apparatus comprises: (a) a collection tank having upper and lower ends, (b) a divider wall that is mounted in the lower end of the tank so as to define a relatively small sub-reservoir therein, (c) a first inlet to the tank in a bottom of the sub-reservoir, for admitting a flow of fuel from the vent line, (d) a second inlet to the tank, located on a side of the divider wall opposite the first inlet, for admitting additional flow of fuel from the vent line, (e) an outlet from the tank for allowing air displaced from the tank to escape through the vent opening, and (f) a float switch mounted in the sub-reservoir defined by the divider wall, for actuating an alarm circuit in response to the sub-reservoir filling with fuel entering through the first inlet in the bottom thereof.

The alarm circuit may comprise an alarm that is mountable to be proximate the location of an operator when refueling. The alarm may comprise a visible alarm light.

The float switch may comprise a magnetic float switch having a shaft aligned vertically in the sub-reservoir, and a float that rises and falls along the shaft in response to fuel filling and draining from the sub-reservoir. The tank may comprise a removable access plate having the float switch mounted thereto, so that that float switch can be removed from the tank for repair or replacement.

The tank may comprise a generally rectangular tank having a flat surface for mounting to a bulkhead or other support. The first inlet may be formed in a bottom wall of the tank, the second inlet may be formed proximate an upper end of a sidewall of the tank, and the outlet may be formed in a top wall of the tank.

The apparatus may further comprise a weep hole formed proximate a bottom end of the divider wall, for allowing fuel to drain through the divider wall and out through the first inlet as fuel drains back down through the vent line.

These and other features and advantages of the present invention will be more fully understood from a reading of the following detailed description with reference to the accompanying drawings.

DETAILED DESCRIPTION

Figure 1:
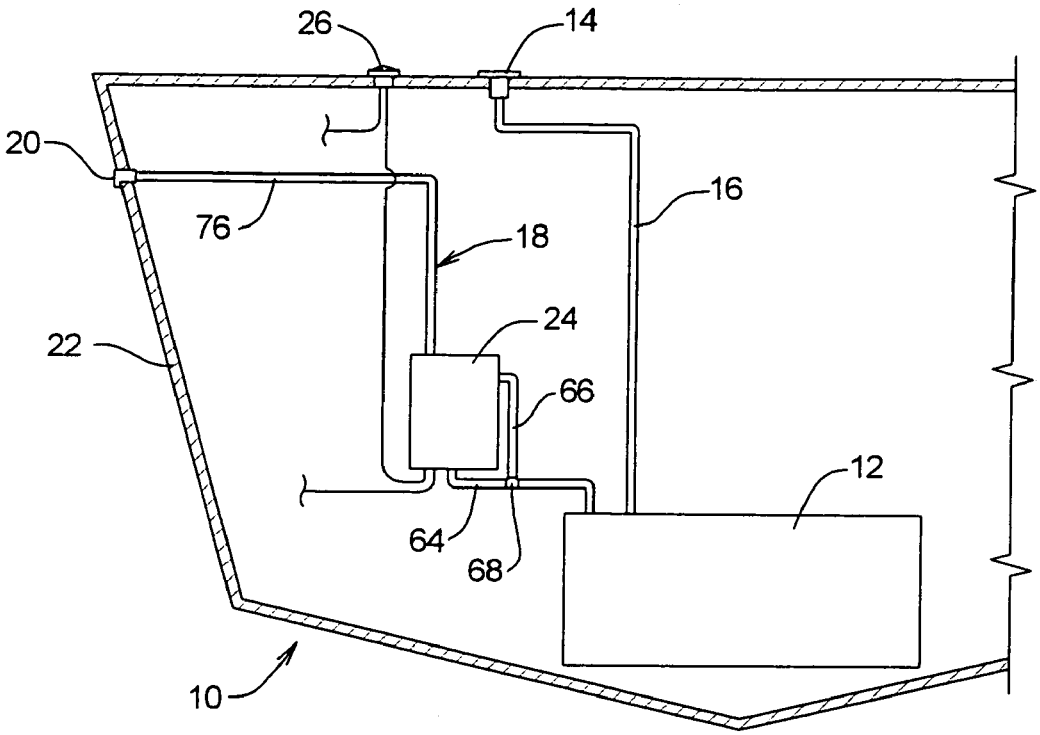
FIG. 1 is an elevational view, partly in cross-section, showing an overflow prevention apparatus in accordance with the present invention installed in the vent line of a fuel system of a conventional boat or other marine craft.

FIG. 1 shows an overflow prevention apparatus in accordance with the present invention, mounted in the fuel system of a boat or other marine watercraft 10. As can be seen, the fuel system includes a main fuel tank 12 that is filled from a deck fitting 14 via an inlet pipe 16. Also included is a vent line 18 that communicates between the fuel tank and a vent opening 20 at the exterior of the hull 22. It will be understood that the actual configuration of the fuel system will vary from craft to craft; in general, however, it is conventional to have the fuel tank mounted low in the craft as shown, with the fill tube and vent line extending in upward directions therefrom.

As can be seen with further reference to FIG. 1, the overflow prevention apparatus of the present invention includes a capture tank 24 that is mounted in the vent line (as opposed to parallel to it), and an alarm device that is actuated upon fuel entering the collection tank, such as the top-side warning light 26 that is shown.

Figure 2:
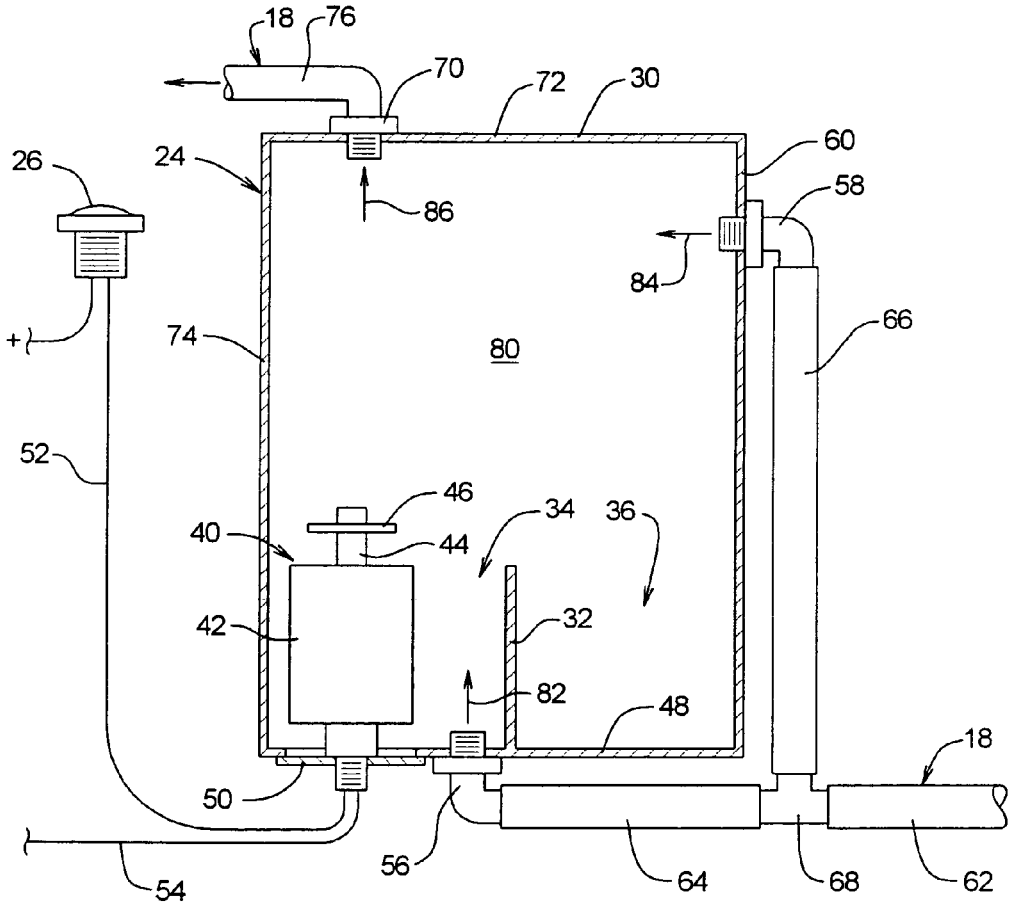
FIG. 2 is a first cross-sectional view of the overflow prevention apparatus of FIG. 1, showing the initial position of the components and the flow of air therethrough, e.g., during operation of the engine or the early stages of refueling.

As can be seen in FIG. 2, the tank 24 includes a shell 30 that is formed of suitable material such as stainless steel or aluminum, for example. The shell preferably has a somewhat flattened (i.e., a relatively short front-to-back distance) rectangular form, with the long axis aligned vertically, which not only facilitates operation of the device but also permits convenient mounting to a bulkhead or other vertical surface; it will be understood, however, that other shapes may also be used.

Figure 3:
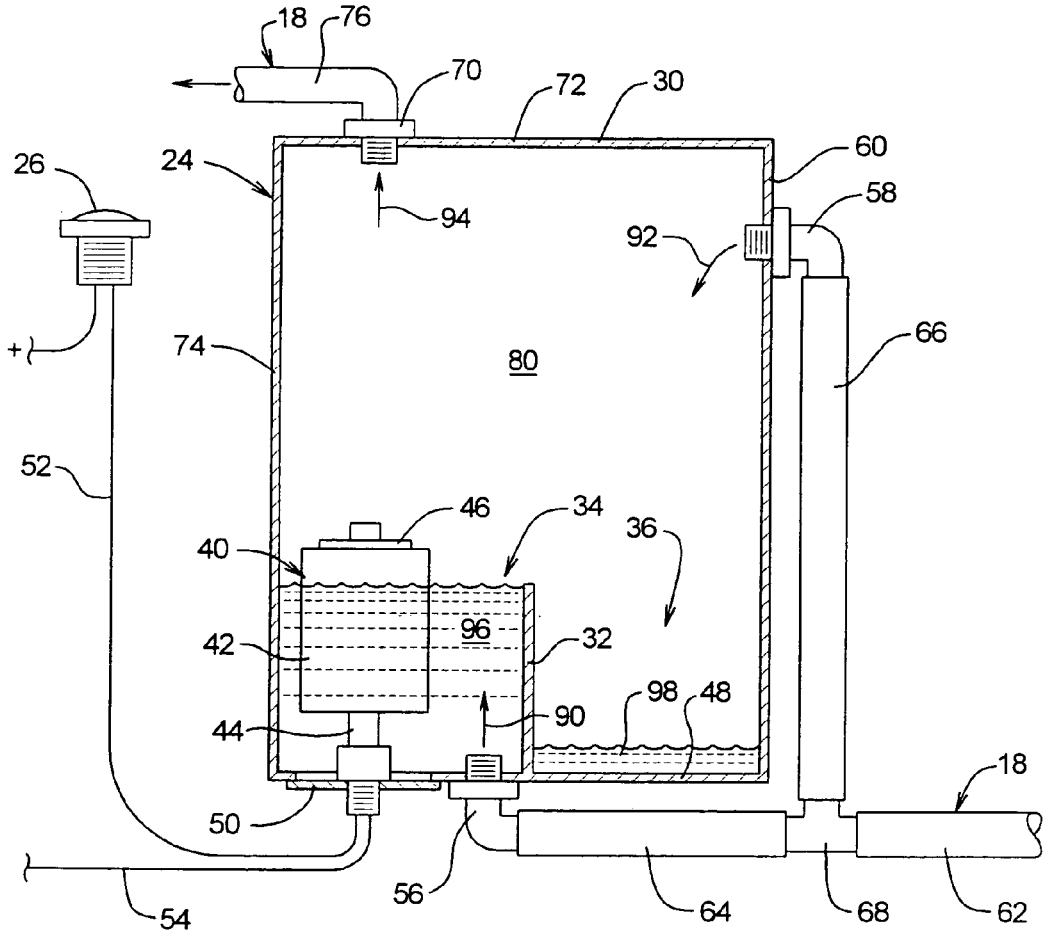
FIG. 3 is a second cross-sectional view of the overflow prevention apparatus of FIG. 1, similar to FIG. 2, showing the manner in which fuel flowing through the vent line during refueling of the main tank first fills the smaller sub-reservoir of the capture tank, so as to actuate an alarm that warns the operator that the main fuel tank is full.
Figure 4:
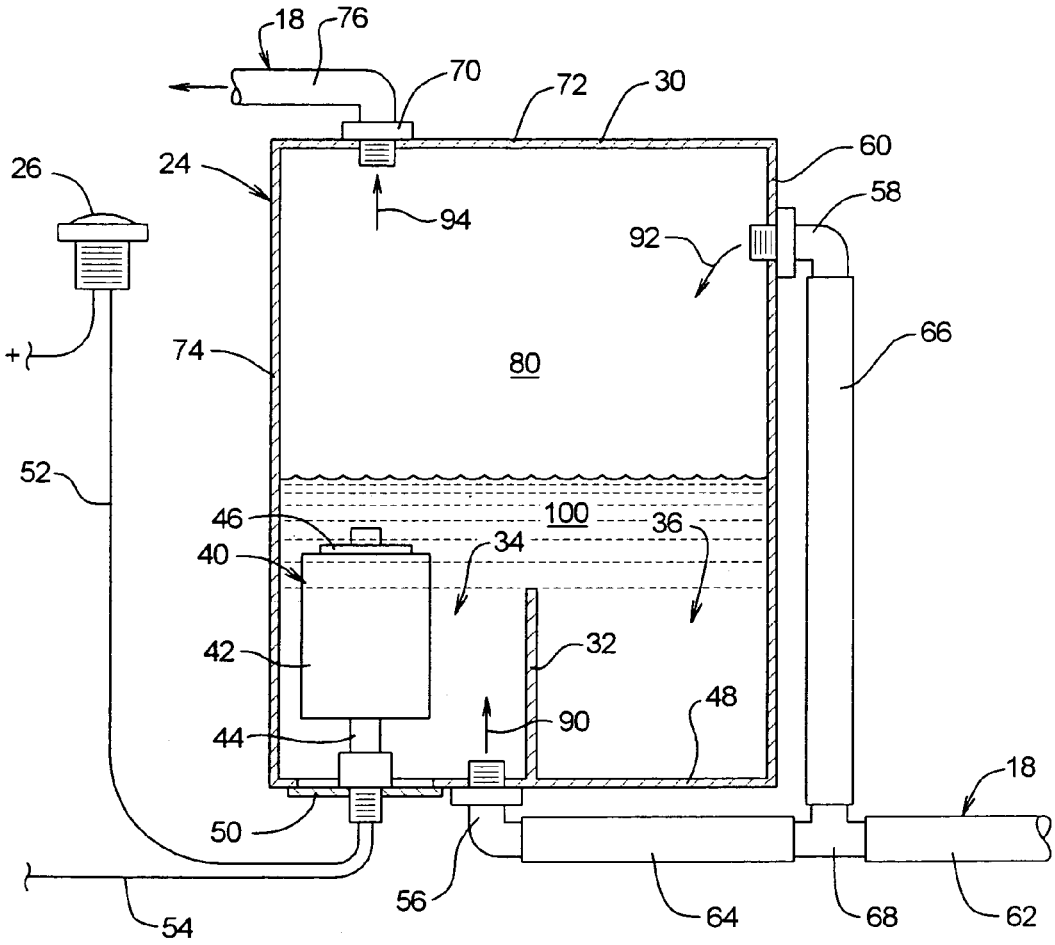
FIG. 4 is a third cross-sectional view of the overflow prevention apparatus of FIG. 1, similar to FIGS. 2-3, showing the manner in which additional flow through the vent line is absorbed by the larger, main reservoir of the capture tank in the event that the operator continues filling for a period after the alarm has been actuated.

A divider wall 32 extends between the front and rear panels of the shell 30 at the bottom end of the collection tank 24, and forms a dam that divides a relatively small chamber or sub-reservoir 34 from the main reservoir 36. In FIGS. 2-4, the reservoir areas 34, 36 appear somewhat similar in size; however, as will be described in greater detail below, the sub-reservoir is sized to have minimal volume so that it fills quickly, generally being only large enough to accommodate the float switch mechanism, while the size of the main reservoir is constrained mainly by cost, packaging and mounting considerations and can therefore be significantly larger even than that which is shown.

A float switch 40 is mounted in the sub-reservoir 34, and includes a float 42 that rises and falls along a vertical shaft 44 in response to changes in the level of a liquid within the chamber 34, upward movement of the float being limited by a stop 46 (e.g., a snap ring). A magnetic float switch is an economical, off-the-shelf component, that employs magnets in the float to close/open a magnetic read switch that is hermetically sealed in the shaft, all of the parts being sealed so that there is no chance of a spark/fire; suitable magnetic float switches of this type are available from National Magnetic Sensors, Inc. (Plantsville, Conn.) and other manufacturers. The float switch is preferably mounted in the bottom panel 48 of the tank on a removable closure plate 50 that is sized larger than the diameter of the float, so that the float switch can be removed from the tank for repair or replacement if needed.

In the installation that is shown in the figures, the two loads 52, 54 of the float switch are connected in a circuit that includes the warning light 26. The internal reed switch is configured to close in response to the float rising on shaft 44, thereby completing the circuit and causing the warning light 26 to illuminate; the warning light is preferably formed by one or more enclosed LEDs, so that again there is no chance of spark/fire. When the float 42 falls, in turn, the switch opens and the warning light is extinguished. In some embodiments, an audible warning (e.g., a horn) may be used in conjunction with or in place of the visual alarm.

The float switch and the manner of its installation that have been described in the preceding paragraphs provide several significant advantages, especially in terms of reliability, safety and low cost. It will be understood, however, that other types of level sensors may be used, in conjunction with or in place of the magnetic float switch that is shown, such as a switch actuated via a lever or other linkage from a float, or an electric sensor, for example.

A first inlet fitting 56 is mounted in the bottom 48 of the tank on the same side of the divider wall 32 as the float switch, while a second, upper inlet fitting 58 is mounted on the opposite side of the divider wall, near the upper end of the side plate 60 of the tank. Both inlet fittings communicate with the lower leg 62 of the vent line 18, via hoses 64, 66 (or other conduits) and a T-connector 68. An outlet fitting 70 in turn is mounted in the upper wall 72 of the tank, preferably near the sidewall 74 opposite that having the upper inlet fitting 58, and communicates with the vent opening 20 via an upper leg 76 of the vent line. The inlet and outlet fittings may be threaded pipe elbows as shown, or may be of any other suitable type, such as welded-on fittings, for example.

The first, bottom inlet opening 56 therefore communicates with the reservoir sub-chamber in which the float switch is mounted, the second inlet fitting communicates with the main interior 80 volume of the tank at a point above the sub-reservoir, and the outlet fitting communicates with the interior of the tank at a point generally above the level of any fuel therein.

Operation of the overflow prevention device will now be described with reference to FIGS. 2-4.

Except during fueling, the capture tank 24 is generally dry, i.e., it is substantially empty of fuel as shown in FIG. 2. Air consequently flows freely to the main fuel tank, via the tank and the upper and lower sections of the vent line 18, allowing the fuel to drain from the tank as it is drawn down by operation of the engine. Likewise, air pressed out of the main tank at the beginning of refueling is able to escape through the vent line and capture tank, in the directions indicated by arrows 82, 84 and 86.

When, during refueling, the main tank becomes full, the fuel rises through the vent line and enters the collection tank through the inlet fittings 56, 58 in the directions indicated by arrows 90, 92 in FIG. 3, while the air continues to escape in the direction indicated by arrows 94. Because the smaller secondary chamber 34 is filled from the bottom, and because its volume is minimal (being only slightly larger than the level switch itself), it is very quickly filled, as indicated at 96 in FIG. 3. The float 42 therefore rises almost immediately to the upper limit of the switch, closing the circuit and illuminating the warning light 26. The operator is thus provided with a visual indication that the main tank is full, while the overall level of fuel in the collection tank 24 is still well below its maximum capacity.

In the event that the operator does not immediately stop the filling of the main tank, the fuel will continue to flow through the lower section of the vent line and into the capture tank, so that its level will rise above the divider wall 32, as indicated at 100 in FIG. 4. The entire upper area 80 of the tank is therefore available to hold the fuel before any will pass through the upper leg 76 of the vent line and reach the hull opening, in practice (due to the relative diameters of the vent line and the filler tube) the fuel will begin backing up the fuel tube well before the capacity of the capture tank is exceeded.

After refueling and during subsequent operation of the engine, the fuel that has been collected within the collection tank 24 will drain back to the main tank via the bottom fitting 56. A small weep hole (not shown) at the bottom of the divider wall 32 allows fuel in the area 36 to drain under the wall and out through the fitting 56.

Figure 5:
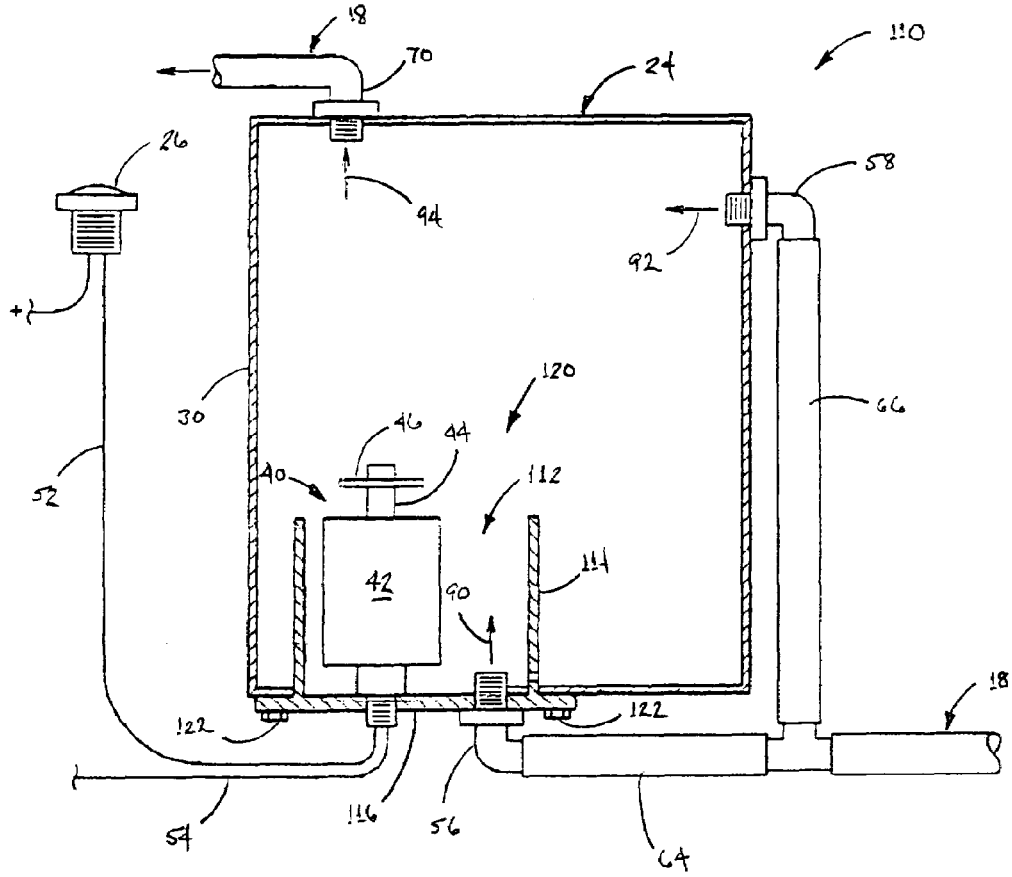
FIG. 5 is an elevational view, partly in cross-section, showing an overflow prevention apparatus in accordance with a second embodiment of the present invention, installed in the vent line of fuel system of conventional boat or other marine craft.
Figure 6:
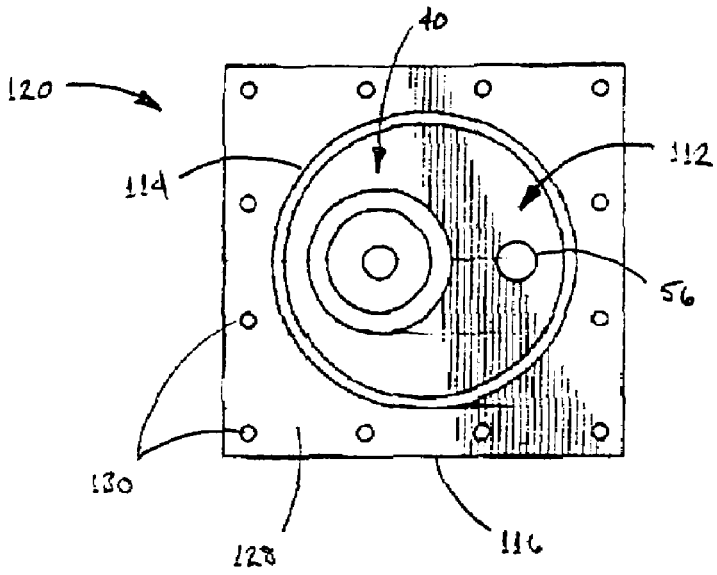
FIG. 6 is a top, plan view of the fuel sensing assembly of the overflow prevention apparatus of FIG. 6, showing the relationship of the divider wall, lower inlet, fitting and float switch in greater detail.
Figure 7:
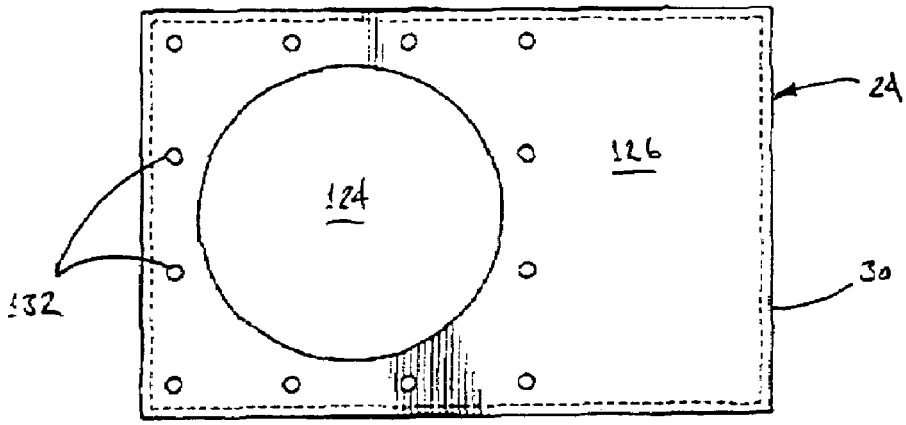
FIG. 7 is a bottom, plan view of the collection tank of the overflow prevention apparatus of FIG. 5, showing the mounting arrangement of the fill sensing assembly in greater detail.

FIGS. 5-7 illustrate a second preferred embodiment of overflow prevention device in accordance with the present invention. With regard to FIGS. 5-7, like reference numerals will be used for like elements as in FIGS. 1-4.

The overflow prevention apparatus 110 of the second embodiment is similar in overall configuration to that described above, and that it includes a capture tank 24, having a shell 30, inlet fittings 56, 58 that are in fluid communication with the lower leg of the vent line 18 so as to remit fuel to flow into the collection tank and the directions indicated by arrows 90, 92, and an outlet fitting 70 that is in fluid communication with the upper leg of the vent line to allow displaced air to escape in the direction indicated by arrow 94. Similarly, the apparatus includes a float switch 40 that actuates a top-side warning light 26 or other warning device, via electrical leads 52, 54.

In this embodiment, however, the float switch is located within a secondary reservoir 112 that is defined by a surrounding divider wall 114, rather than a wall that spans the sides of the main containment tank as shown above. The surrounding divider wall extends upwardly from a base plate 116, and thus encloses a secondary, open-topped chamber around the float switch 40. The lower inlet fitting is also mounted to the base plate 116 inside the wall 114, so that fuel entering through the fitting fills the sub-reservoir in the same manner as described above.

The base plate 116, enclosure wall 114 and float switch 40 in combination thus form a sensing assembly 120 that mounts to the bottom of the main collection tank, by bolts 122 or other suitable fasteners. As compared with the above-described embodiment, this arrangement facilitates manufacture of the apparatus, since it avoids the need to weld or otherwise join the edges of a divider wall to the side walls of the tank shell 30, and also makes for easier cleaning of the tank when necessary.

As can be seen in FIGS. 6-7 the enclosure wall 114 is suitably cylindrical in form, which allows it to be constructed of a short length of pipe welded or otherwise mounted to the base plate 116. The upstanding enclosure wall fits into a circular cutout 124 in the bottom wall 126 of the tank shell 30, with a gasket (not shown), layer of sealant, or other form of seal being provided between the flange portion 128 of the base plate and the bottom wall 126. Bolts 122 (see FIG. 5) are then passed through cooperating bores 130, 132 to removably secure the sensing assembly 120 in the bottom of the collector tank.

The cylindrical enclosure wall 114 and square-flanged base plate 128 provide certain advantages in terms of economy of fabrication and ease of assembly, however, it will be understood that other shapes may be used depending on a variety of design factors.

The apparatus of the present invention thus provides an immediate warning to the operator when the main tank is full and fuel begins rising through the vent line, well before the capacity of the capture tank is reached, obviating any possibility that fuel will be discharged into the water through the vent opening. Moreover, the apparatus is robust and reliable, yet is economically produced due to the comparative simplicity of its construction and use of off-the-shelf parts. Moreover, the collection tank can be mounted at any suitable hull location, with the warning light in turn being mounted at a remote location where it is readily visible to the operator.

It is to be recognized that various alterations, modifications, and/or additions may be introduced into the constructions and arrangements of parts described above without departing from the spirit or ambit of the present invention.

What is claimed is:

1. An apparatus for preventing discharge of fuel from a vent line of a boat or other marine craft when fueling, said apparatus comprising:

a collection tank having upper and lower ends;

a divider mounted in a lower end of said collection tank that defines a relatively small sub-reservoir therein;

a first inlet to said collection tank located in the bottom of said sub-reservoir, that admits a flow of fuel from said vent line;

a second inlet to said collection tank located on a side of said divider opposite said first inlet, that admits an additional flow of fuel from said vent line;

an outlet from said collection tank that allows displaced air to escape from said tank; and a liquid level sensor mounted in said sub-reservoir defined by said divider, that actuates an alarm circuit in response to said sub-reservoir filling with fuel entering via said first inlet in said sub-reservoir.

2. The apparatus of claim 1, wherein said liquid level sensor comprises:

a float switch.

3. The apparatus of claim 1, wherein said alarm circuit comprises:

an alarm that is mountable in a position proximate a predetermined location of an operator when fueling.

4. The apparatus of claim 3, wherein said alarm comprises:

a warning light.

5. The apparatus of claim 1, wherein said float switch comprises:

a magnetic float switch having a shaft that is aligned substantially vertically in said sub-reservoir and a float that rises and falls along said shaft in response to fuel filling and draining from said sub-reservoir.

6. The apparatus of claim 5, wherein said collection tank comprises:

a removable access plate having said float switch mounted thereto, so that said float switch can be removed from said tank via said access plate.

7. The apparatus of claim 1, wherein said divider comprises:

a divider wall that is mounted between first and second side walls of said collection tank so as to define said relatively small sub-reservoir.

8. The apparatus of claim 1, wherein said divider comprises:

an enclosure wall forming an open-ended chamber that extends upwardly from said lower end of said collection tank so as to define said relatively small sub-reservoir.

9. The apparatus of claim 8, wherein said open ended chamber comprises:

a substantially cylindrical chamber having an open upper end.

10. The apparatus of claim 8, wherein said collection tank comprises:

a removable plate having said chamber and said float switch mounted thereon, so that said chamber and float switch can be removed from and installed in said tank as a unit.

11. The apparatus of claim 1, wherein said collection tank comprises:

a generally rectangular tank having a flat surface for mounting to a bulkhead or similar planar support.

12. The apparatus of claim 11, wherein said first inlet is formed in a bottom wall of said rectangular tank, said second inlet is formed proximate an upper end of a side wall of said rectangular tank, and said outlet is formed in a top wall of said rectangular tank.

13. The apparatus of claim 1, further comprising:

a weep hole formed proximate a bottom end of said divider that allows fuel to drain through said divider and into said first inlet as fuel drains back down said vent line.

14. An apparatus of claim 1, further comprising:

inlet pipes that connect both said first inlet and said second inlet to a leg of said vent line leading to a fuel tank of said boat or other marine craft.

15. An apparatus of claim 14, further comprising:

an outlet pipe that connects said outlet from said collection tank to a leg of said vent line leading to an overboard vent of said boat or other marine craft.

16. An apparatus for preventing a discharge of fuel from a vent line of a boat or other marine craft when fueling, said apparatus comprising:

a collection tank having top and bottom walls and at least one side wall;

a divider wall that is mounted across an interior of said collection tank so as to define a relatively small sub-reservoir therein;

a first inlet fitting mounted in said bottom wall of said collection tank within said sub-reservoir;

a second inlet mounted in a side wall of said collection tank on a side of said divider wall opposite said sub-reservoir;

a outlet fitting mounted in said top wall of said collection tank;

a float switch mounted in said sub-reservoir;

an alarm device operatively connected to said float switch so as to be activated in response to filling of said sub-reservoir;

first and second pipes that connect said first and second inlet fittings to a leg of said vent line leading to a fuel tank of said boat or other marine craft; and a third pipe connecting said outlet fitting to a leg of said vent line leading to an overboard vent of said boat or other marine craft;

whereby fuel exiting said fuel tank through said vent line enters said collection tank via of both said first and second inlet fittings, while air is displaced via said outlet fitting, so that said fuel fills said relatively small sub-reservoir and activates said alarm device well in advance of said collection tank becoming filled so that fuel that might overflow through said overboard vent.

17. An apparatus for preventing discharge of fuel from a vent of a boat line or other marine craft when fueling, said apparatus comprising:

a collection tank having a top and bottom walls;

a fill sensing assembly that mounts as a unit and said bottom wall of said collection tank, said fill sensing assembly comprises:

a base plate removably mounted to said bottom wall of said collection tank:

an enclosure wall extending upwardly from said base plate so as to define a relatively small sub-reservoir having an open upper end:

a first inlet fitting mounted to said base plate within said enclosure wall, for admitting a flow of fuel into said sub-reservoir; and a float switch sensor mounted within said enclosure wall for detecting a rise of fuel within said sub-reservoir;

a second inlet fitting mounted in a side wall of said collection tank on a side of said enclosure wall opposite said first inlet fitting, for also admitting a flow of fuel to said collection tank;

an outlet fitting mounted in said top wall of said collection tank for allowing air to be displaced from said collection tank;

an alarm device operatively collected to said float switch so as to be activated in response to filling of said sub-reservoir;

first and second pipes connecting said first and second inlet fittings to a leg of said vent line leading to a fuel tank of said boat or other marine craft; and a third pipe connecting said outlet fitting to a leg of said vent line leading to an overboard vent of said boat or other marine craft;

whereby fuel exiting said fuel tank through said vent line enters said collection tank via of both said first and second inlet fittings, while air is displaced via said outlet fitting, so that said fuel fills said relatively small sub-reservoir and activates said alarm device well in advance of said collection tank becoming filled so that fuel that might overflow through said overboard vent.

* * * * *